US006093116A

United States Patent [19]

Hettinger et al.

[11] Patent Number: 6,093,116

[45] Date of Patent: Jul. 25, 2000

[54] GOLF CLUB HEAD WITH VIBRATION DAMPING CHANNELS

[75] Inventors: Ronald K. Hettinger, Oceanside; J. Neil Hall, Carlsbad; Ruben Ruiz, Escondido, all of Calif.

[73] Assignee: Callaway Golf Company, Carlsbad, Calif.

[21] Appl. No.: 09/218,733

[22] Filed: Dec. 22, 1998

[51] Int. Cl.[7] ..... A63B 53/04

[52] U.S. Cl. ..... 473/332; 473/342

[58] Field of Search ..... 473/324, 332, 473/330, 342, 346, 329

[56] References Cited

U.S. PATENT DOCUMENTS 1,968,626 7/1934 Young ..... 473/342

2,034,936 3/1936 Barnhart ..... 473/342

*Primary Examiner*—Kien T. Nguyen

*Attorney, Agent, or Firm*—Michael A. Catania; Lyon & Lyon LLC

[57] ABSTRACT

A golf club head having a face insert plate. The face insert plate is affixed to a faceplate mounting surface wherein a plurality of channels are formed. The channels preferably have a depth that is increased in a lower region of a face of the club head. An elastomeric binding material and damping agent is provided within the channels to affix the face insert plate to the face plate mounting surface and to provide a vibration damping function. In a preferred form, the faceplate mounting surface comprises a base wall of a face insert receiving cavity or recess that is formed within a main body of the club head.

29 Claims, 2 Drawing Sheets

GOLF CLUB HEAD WITH VIBRATION DAMPING CHANNELS

BACKGROUND OF THE INVENTION

1. Field of the Invention

This invention relates generally to golf club heads having face insert plates, and more particularly, to golf club heads having a face insert plate that is mounted within a cavity formed within a face region of a club head body. The face insert cavity preferably has varying depth channels provided in a bottom surface thereof, and has an elastomeric damping material provided within the channels.

2. Description of Related Art

There have been numerous attempts to utilize face inserts or faceplates of differing materials on golf club heads. Indeed, such structures have previously been proposed for both wood and iron-style club heads and for putter heads. For example, U.S. Pat. Nos. 5,403,007 and 3,975,023 disclose the use of face inserts within golf club heads. Further, some golf club heads, primarily putter heads, utilize elastomeric materials for the face insert, such as is disclosed in U.S. Pat. No. 5,575,472 (co-owned by the assignee of the present invention).

Those skilled in the art will appreciate that, while the "feel" of a golf club may be to some extent non-quantifiable, feel is an important factor in club design. Those skilled in the art also will appreciate that the feel of a golf club, particularly that of a wedge or putter, may constitute the very thing that causes a player to choose one club over another. Thus, it is believed that those skilled in the art would find a golf club head having a face insert plate that provides an enhanced or improved feel to be quite useful.

SUMMARY OF THE INVENTION

In one innovative aspect, the present invention is directed to a golf club head having a recess formed within a face region thereof for receiving a face insert plate. A bottom wall of the recess preferably has a plurality of channels formed therein, and the depth of the channels preferably varies between an upper region of the club head face and a lower region of the club head face. Indeed, in one preferred embodiment the maximum depth of the channels within the lower region of the club head face is more than twice the depth of the channels within the upper region of the club head face. Preferably, an elastomeric binding material is deposited within the channels of the recess and is used to bond or secure the face insert plate within the recess. The elastomeric binding material also provides a vibration damping function.

Because additional amounts of the elastomeric binding material are provided within the sections of the channels formed within the lower region of the club head face, it is believed that additional vibration damping will be provided for shots hit low on the club head face. Further, it is believed that by utilizing a club head in accordance with the present invention it may be possible to produce, for example, a wedge type golf club having an improved feel and/or improved playability characteristics.

In another innovative aspect, the face cavity or recess may include a side wall, which encloses and defines a perimeter of the face cavity or recess, and a base wall in which the channels are formed. The side wall may have a lower section whereon a plurality of face insert plate positioning nubs are formed. In such an embodiment, the face insert plate positioning nubs may be used, for example, to ensure that the face insert plate is seated within the center of the face cavity or recess.

In a further innovative aspect, the plurality of channels may comprise first and second sets of channels that intersect one another, and the first and second sets of channels may have an orthogonal relationship.

In another innovative aspect, the depth of each channel may vary from an upper region of the club head face to a lower region of the club head face. Moreover, in one presently preferred embodiment the channels have a constant depth within an upper region of the club head face and a depth that varies linearly within the lower regions of the club head face, such that a maximum channel depth within the lower region of the club head face is substantially twice the depth of the channels within the upper region of the club head face.

Those skilled in the art will appreciate that in alternative embodiments, the face insert plate need not be provided within an enclosed recess. For example, it may be sufficient for the face insert plate to be bounded by a pair of said walls or, alternatively, the face insert plate may merely be secured to a faceplate mounting surface of the club head. In the latter embodiment, it may be desirable to provide one or more engaging structures on, for example, the bottom surface of the face insert plate and the surface to which the faceplate is bonded. The engaging structures may take the form, for example, of one or more male extrusions provided on the bottom surface of the faceplate and one or more corresponding female receptacles on the surface to which the faceplate is bonded.

In view of the foregoing, it is an object of the present invention to provide a golf club head having a face insert plate and an improved feel.

It is another object of the present invention to provide a means for varying a degree of damping within predetermined regions of a face of a golf club head, and to provide a golf club head that incorporates such means.

It is still another object of the present invention to provide a golf club head having a face plate that is bonded to a bottom wall of a face insert recess in such a manner that increased amounts of a binding material may be provided within a lower region of the club head face to better secure the face insert to the bottom wall of the face insert recess and to enhance vibration damping within a lower region of the club head face.

Other objects and features of the present invention will become apparent from consideration of the following description taken in conjunction with the accompanying drawings.

DETAILED DESCRIPTION OF THE PREFERRED EMBODIMENTS

Figure 1:
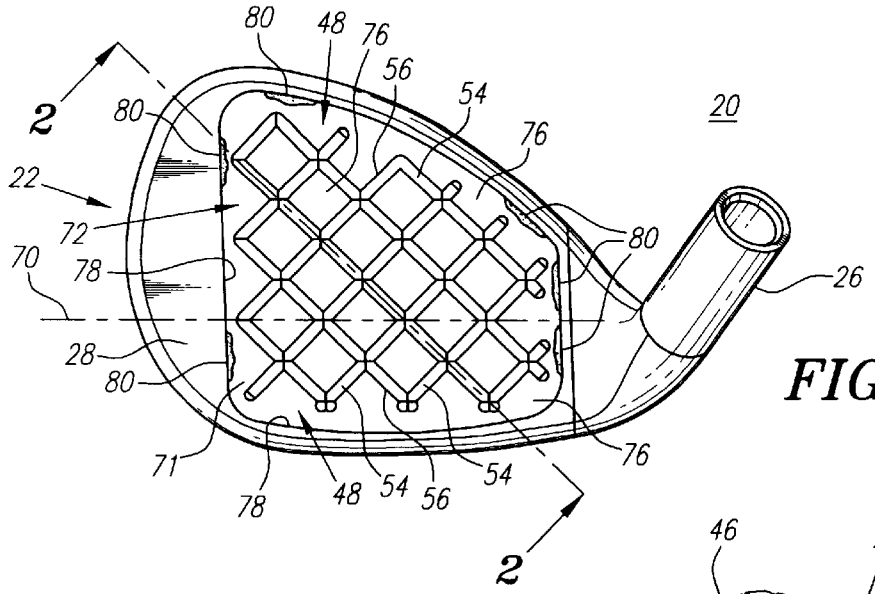
FIG. 1 is a front elevation view of a main body section of a golf club head showing a cavity formed within a face section of the main body.

Having reference to the drawings, wherein like reference numerals indicate corresponding elements, there is shown in FIG. 1 an illustration of a golf club head 20 in accordance with a preferred form of the present invention. The golf club head 20 includes a metallic, preferably investment cast, main club head body 22, and a face insert plate 24 (shown in FIGS. 3–5).

FIG. 1 depicts the club head body 22 which includes a front face cavity or recess 48 used to receive and position the face insert plate 24 therein. The face cavity 48 includes a base wall 76, a side wall 78 and a plurality of channels 54.

As illustrated in FIG. 1, in a presently preferred embodiment, the base wall 76 of the cavity 48 has a plurality of channels 54 of varying depth provided therein. As will be described in greater detail below, the channels 54 are designed to receive, for example, an elastomeric binding material that, when cured, has the ability to act as a vibration damping agent. Thus, it will be appreciated that through the use of a plurality of channels 54 in accordance with the present invention it is possible to securely bond the face insert plate 24 to the base wall 76 of the cavity 48, and by varying the configuration and/or depth of the channels 54, it is possible to vary the amount of damping material that is provided within various regions of the face cavity 48 of the club head 20.

Figure 2:
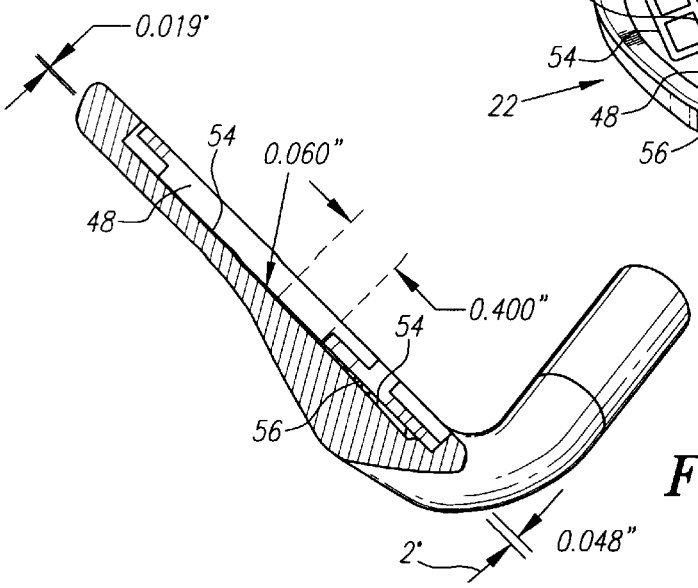
FIG. 2 is a cross-sectional view of the face section of the golf club head body shown in FIG. 1.

Turning now also to FIG. 2, in a preferred form, the channels 54 have a minimum depth of 0.019 inch, an internal radius of curvature of 0.060 inch, and a trough-to-trough separation of 0.400 inch. In addition, the channels 54 preferably vary in depth between an upper region 72 and lower region 71 of the face cavity 48, as divided by line 70 (shown in FIG. 1). As shown in FIG. 2, the channels 54 preferably have a depth of 0.019 inch within the upper region 72 of the face cavity 48, and in the lower region 71 of the face cavity 48, the channels 54 have a depth that increases to 0.048 inch.

Further, in one presently preferred embodiment, the channels 54 comprise two sub-sets with one sub-set running in one direction, and the other sub-set running in another direction, such that the channels comprising the two sub-sets intersect at approximately 90° angles. The channels 54 also preferably are arranged such that they intersect a vertical plane orthogonal to said face at substantially a 45° angle when the golf club head is properly positioned to address a golf ball.

During manufacture of the club head body 22, the channels 54 receive an elastomeric binding material and damping agent 64 (shown in FIG. 3) that holds the face insert plate 24 in the face cavity 48. Thus, in the presently preferred embodiment, a greater amount of the elastomeric binding material and damping agent 64 is provided within the channels 54 located within a lower section 71 of the front face cavity 48. It is believed that the provision of increased amounts of the elastomeric binding material and damping agent 64 within the lower regions 71 of the front face cavity 48 will improve the playability and feel of a golf club employing the golf club head 20, because most balls are struck using the lower portion 71 of the golf club head 20.

As explained below, the front face cavity 48 provides a location wherein the face insert plate 24 (shown in FIGS. 3–5) may be secured to the golf club head body 20 using the elastomeric binding material and damping agent 64. To assure proper centering of the face insert plate 24, a plurality of faceplate positioning nubs 80 (as shown in FIG. 1) preferably are located at selected locations along the side wall 78 of the cavity 48. The faceplate positioning nubs 80 preferably have a height of approximately 0.082 inch, and are approximately ½ as tall as the side wall 78. In addition, the faceplates positioning nubs 80 preferably have a thickness of approximately 0.020 inch. Thus, when the face insert plate 24 is fixed within the cavity 48, the outer edge (not shown) of the face insert plate 24 abuts the faceplate positioning nubs 80 and is separated from a remainder of the side wall 78 by approximately 0.020 inch. This insures that the elastomeric binding material and damping agent 64 used to secure the face insert plate 24 within the cavity 48 may completely surround the periphery of the face insert plate 24.

Figure 3:
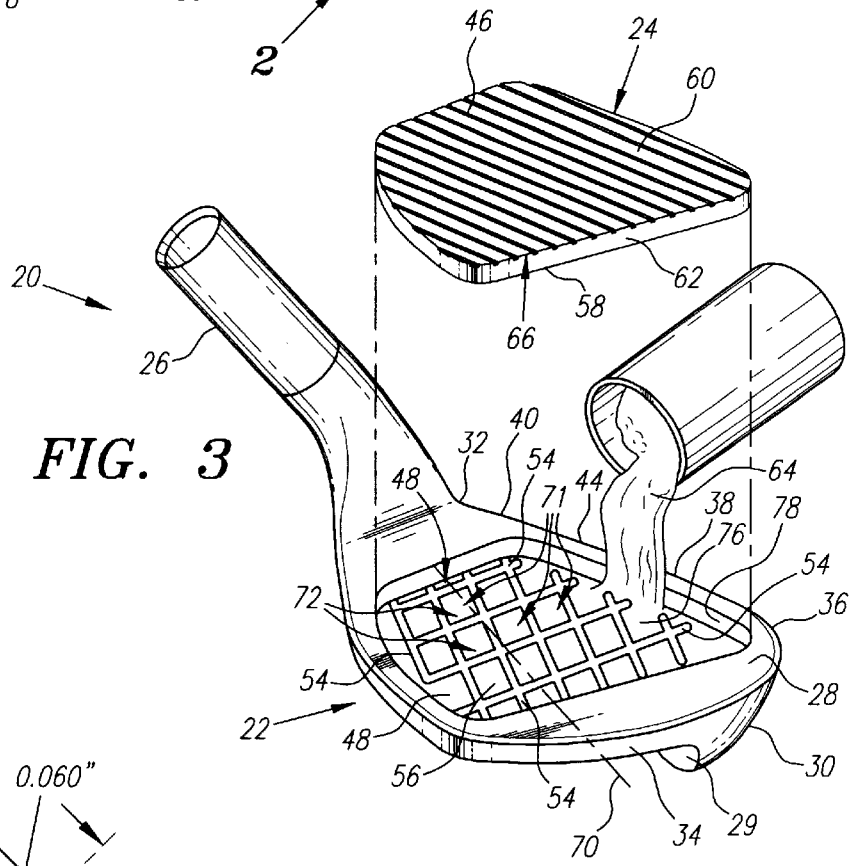
FIG. 3 is an exploded assembly perspective view of the club head.

Turning now to FIG. 3, the main club head body 22 is shown, as it would look in its investment cast state, i.e., after initial casting and finishing (as described below). During the manufacturing process, when the face insert plate 24 is fixed within the face cavity 48, it is desired that as little separation as possible be provided between the back surface 58 of the face insert plate 24 and the base wall 76 of the face cavity 48. Although a very thin layer of elastomeric binding material and damping agent 64 may exist between the back surface 58 of the face insert plate 24 and the base wall 76 of the face cavity 48 when the face insert plate 24 is mounted in the face cavity 48, it is preferred that the back surface 58 of the face insert plate 24 be positioned against the base wall 76 of the face cavity 48. Moreover, the face insert plate 24 preferably is bonded in place by the elastomeric binding material that is provided within the channels 54 of the face cavity 48.

As shown, the insert plate 24, besides its back surface 58, includes a front strike surface 60 (in which are formed the scorelines 46), as well as a peripheral edge wall 62. The edge wall 62 is so shaped (in whatever desired configuration) so as to closely correspond in shape and dimension to the peripheral wall 78 of the face cavity 48. Preferably, a gap of between 0.005 and 0.020 inch is provided between the peripheral edge wall 62 of the face insert plate 24 and the perimeter wall 78 of the face cavity 48.

As explained above, the main club head body 22 preferably is investment cast of a stainless steel material, such as 303 stainless. However, those skilled in the art will recognize that numerous other materials such as titanium could also be used in manufacturing a club head body 22 in accordance with the present invention. Further, it will be appreciated that the club head body 22 could be manufactured via, for example, a forging process.

As stated above, the face insert plate 24 is secured within the face cavity 48 by use of an appropriate elastomeric material and damping agent 64 designated generally by reference numeral 64. In the preferred embodiment, the elastomeric material 64 comprises a thermosetting elastomer or thermoplastic polymer. Preferably such elastomeric materials include thermosetting urethane, phenolic and polyester. The only prerequisite for elastomer 64 is that it be pourable and curable via heat. Also, preferably the elastomer should have a Durometer rating in the range of approximately 45 to 90 Shore D.

As a first step for manufacturing the a golf club head 20 in accordance with the present invention, the metallic club head body 22 is cast. The cast club head body 22 preferably has the face insert cavity 48 formed therein, and the face insert cavity 48 preferably has a base wall 76, wherein the channels 54 are located. Further, as explained above, the channels 54 in the lower region 71 of the face cavity 48 are deeper than the channels 54 in the upper region 72 of the face cavity 48. Preferably, the cast club head body 22 is designed to be used "as cast", i.e., where the casting tolerances are maintained as tight as the investment casting process will reasonably allow. This helps eliminate any unneeded further finishing or milling of the insert cavity 48 prior to its receiving the elastomeric material 64 and face insert plate 24.

As a next step, and after the club head body 22 has been cast, the club head body 22 is "de-shelled" (investment casting shell removed), the unneeded casting gates are ground off of the club head, and the entire club head body 22 is sandblasted and pre-finished.

Thereafter, the face cavity 48 is sand blasted and the finished club head body 22 is degreased with particular attention being paid to the face cavity 48. Thereafter, the club head body 22, as so prepared, is placed in an appropriate bonding fixture, so that the front strike face 28 of club head body 22 is maintained horizontal and points upwardly.

As a next step, the thermoset elastomer material 64 is blended, and a measured amount is poured into the face cavity 48 until the level thereof is slightly above the top edge surfaces 56 of the respective channels 54 in the face cavity 48. As a result of creating deeper channels 54 in the lower region 71 of the face cavity 48, the channels 54 in that region accumulate a greater amount of elastomer material 64.

Thereafter, a thin sheet of adhesive plastic is adhered to the face of the face insert plate 24 to keep elastomer out of the face insert scorelines 46 before the insert 24 is installed.

Immediately thereafter, the face insert plate 24 preferably is installed into the face cavity 48, and a minimal clamping force (via well-known insert clamping means not shown) is applied to the respective strike face surfaces 28 and 60 so that the same are made to lie coplanar, as is desired with the present invention. Also, through use of such clamping forces, any excess thermoset elastomer material 64, while it is still uncured, is forced to fill all voids within the face cavity 48. Those skilled in the art will appreciate that the term "voids," as used in the previous sentence, refers to those spaces or volumes within the face cavity 48 that are not occupied by the face insert plate 24. Thus, in a preferred form, the "voids" will comprise the varying depth channels 54 and a space (not shown) that may exist between the peripheral edge wall 62 of the face insert plate 24 and the corresponding peripheral wall 78 of the face cavity 48. This latter void, located between the peripheral edge wall 62 of face insert plate 24 and the corresponding peripheral wall 78 of face cavity 48, may be provided and filled to ease manufacturing tolerances and/or for aesthetic reasons. Further, and importantly, the elastomeric material cures to provide a secure adhesive fastening of the insert face plate 24 to the club head body 22.

Thereafter, once several hours of curing time has lapsed, the club head 20 (comprising club head body portion 22 and the now secured face insert plate 24) is removed from the bonding fixture.

Then, normal and well-known club head finishing procedures are followed to complete the finishing of club head 22.

During the club head finishing procedure, each club head 22 is individually ground and polished using appropriate grits of belt sanding. The strike face 28 surrounding the face insert plate 24 is belted down until it is coplanar with the face insert plate 24. The casting tolerances are preferably designed such that the strike face 28 stands taller than the face insert plate 24 after insertion so that the strike face 28 needs to be sand belted.

Additional method steps, if desired, for making the club head 20 of the present invention include the following:

a) As a preliminary step, the insert cavity 48 can be milled out to better prepare and clean up the same, if the surfaces of the cast club head body 22 remain too rough;

b) The face cavity 48 and the channels 54 can be rough-cast, and then the base wall 76 of the cavity 48 can be milled such that any surface area between the respective channels conforms to an appropriate uniform height;

c) Step b) above can be performed, plus profile milling of the peripheral wall edge 52 of insert face cavity 48, so that the wall 52 correctly matches the shape of the corresponding edge wall 62 of face insert plate 24; and d) Both steps b) and c) above can be performed, plus milling of the front strike face surface 28 of club head body 22 prior to introduction of the pourable and curable elastomeric material 64 and face insert plate 24.

Figure 4:
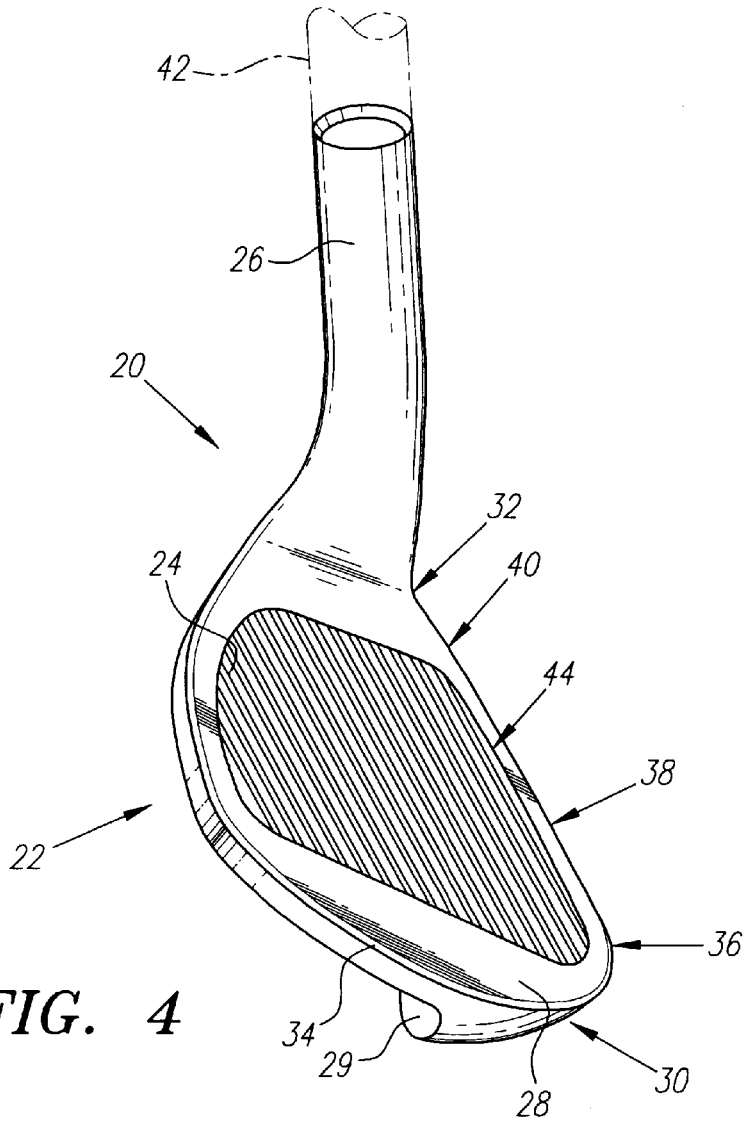
FIG. 4 is a toe end front perspective view of the club head of the present invention.
Figure 5:
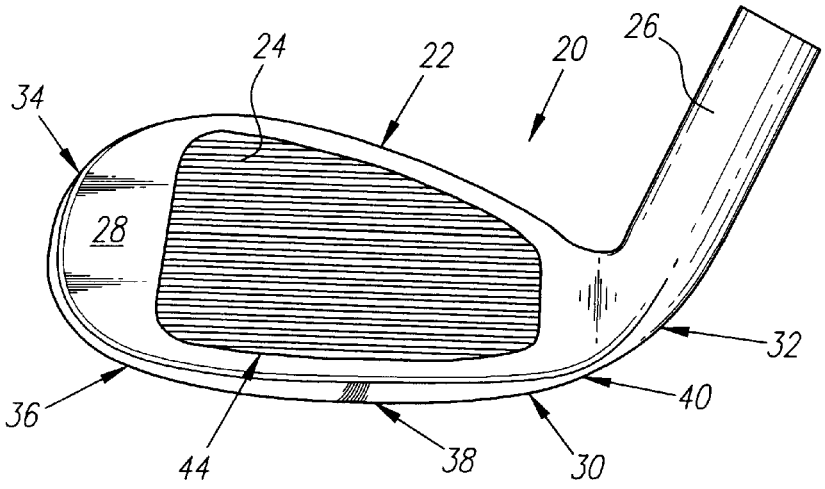
FIG. 5 is a front elevational view of the club head of FIG. 4, as shown in a ball address position.

Turning to FIG. 4, the club head body 22 is further shown to include a hosel 26, a front strike face 28, a back face 29, a sole 30, a heel end 32, and a toe end 34. The sole 30 generally includes sole toe section 36, sole midsection 38, and sole heel section 40. A shaft section 42 (shown in phantom) connects to the hosel 26.

As shown, the club head 20 takes the form of a wedge type club head and has a 56° loft angle. However, those skilled in the art will appreciate that the loft angle of the club head 20 may vary, for example, for iron or wedge type club heads from 19° to 61° and for wood type golf club heads from 6° to 31°.

While the invention is susceptible to various modifications and alternative forms, specific examples thereof have been shown in the drawings and are herein described in detail. It should be understood, however, that the invention is not to be limited to the particular forms or methods disclosed, but to the contrary, the invention is to cover all modifications, equivalents, and alternatives falling within the spirit and scope of the appended claims.

What is claimed is:

1. A golf club head comprising:

a club head body and face insert plate, said club head body having a face plate mounting surface to which said face insert plate is bonded, said face plate mounting surface having a plurality of varying depth channels formed therein, and an elastomeric binding material being provided within said channels for bonding said face insert plate to said face plate mounting surface and for performing a vibration damping function.

2. The golf club head of claim 1, wherein said face plate mounting surface includes a lower region and an upper region, and wherein sections of said channels in said lower region are deeper than sections of said channels in said upper region.

3. The golf club head of claim 2, wherein the depth of each said channel in said lower region decreases linearly as each said channel approaches said upper region.

4. The golf club head of claim 2, wherein the depth of each said channel in said upper region increases linearly as each said channel approaches said lower region.

5. The golf club head of claim 2, wherein said face plate mounting surface comprises a base wall of a face insert cavity formed within a face region of said club head body.

6. The golf club head of claim 5, wherein said channels include a first set of channels that intersect a second set of channels at a predetermined angle.

7. The golf club head of claim 6, wherein said first and second sets of channels have an orthogonal relationship, and wherein said sets of channels intersect a vertical plane orthogonal to said face at substantially a 45° angle when said golf club head is properly positioned to address a golf ball.

8. The golf club head of claim 5, wherein said face insert cavity has a side wall extending around an entire perimeter of said cavity.

9. The golf club head of claim 8, wherein said side wall has a lower section whereon a plurality of face insert plate positioning nubs are formed.

10. The golf club head of claim 2, wherein said channels include a first set of channels that intersects a second set of channels at a predetermined angle.

11. The golf club head of claim 10, wherein said first and second sets of channels have an orthogonal relationship, and wherein said sets of channels intersect a vertical plane orthogonal to said face at substantially a 45° angle when said golf club head is properly positioned to address a golf ball.

12. The golf club head of claim 11, wherein the depth of each said channel in said lower region decreases linearly as each said channel approaches said upper region, and wherein the depth of each said channel in said upper region increases linearly as each said channel approaches said lower region.

13. The golf club head of claim 2, wherein each said channel in said lower region has a maximum depth of substantially 0.048 inches, and each said channel in said upper region has a maximum depth of substantially 0.019 inches.

14. The golf club head of claim 13, wherein said channels in said lower and upper regions have an internal radius of curvature of substantially 0.060 inches, and have a trough-to-trough separation of substantially 0.400 inches.

15. The golf club head of claim 1, wherein said face plate mounting surface comprises a base wall of a face insert cavity formed within a face region of said club head body.

16. The golf club head of claim 1, wherein said plurality of channels includes a first set of channels that intersect a second set of channels at a predetermined angle.

17. The golf club head of claim 16, wherein said first and second sets of channels have an orthogonal relationship, and wherein said sets of channels intersect a vertical plane orthogonal to said face at substantially a 45° angle when said golf club head is properly positioned to address a golf ball.

18. A golf club head comprising:

a club head body and a face insert plate, said club head body including a face plate mounting surface having a lower region and an upper region, and said face plate mounting surface having a plurality of lower region channels formed in said lower region and a plurality of upper region channels formed in said upper region, wherein said lower region channels have a depth greater than a depth of said upper region channels, and wherein said channels formed within said face plate mounting surface have binding and damping material provided therein for affixing said face insert plate to said face plate mounting surface.

19. The golf club head of claim 18, wherein said faceplate mounting surface comprises a base wall of a face insert receiving cavity.

20. The golf club head of claim 19, wherein said cavity has a side wall extending around an entire perimeter of said cavity.

21. The golf club head of claim 20, wherein said side wall has a lower section whereon a plurality of face insert plate positioning nubs are formed.

22. A method of manufacturing a golf club head, said method comprising steps of:

forming a club head body, said club head body having a face insert receiving cavity, forming a plurality of channels having a varying depth within a base wall of said face insert receiving cavity;

injecting binding material into said face insert receiving cavity; and affixing a face plate within said face insert receiving cavity.

23. The method of claim 22, wherein said face insert cavity includes a lower region and an upper region, and wherein forming sections of said channels in said lower region have a depth that exceeds a depth of said channels in said upper region.

24. The method of claim 23, wherein forming said channels include a first set of channels that intersects a second set of channels at a predetermined angle.

25. The method of claim 24, wherein said first and second sets of channels have an orthogonal relationship, and wherein forming said sets of channels to intersect a vertical plane orthogonal to said face at substantially a 45° angle when said golf club head is properly positioned to address a golf ball.

26. The method of claim 25, wherein forming a depth of each said channel in said lower region to decrease linearly as each said channel approaches said upper region, and wherein forming a depth of each said channel in said upper region to increase linearly as each said channel approaches said lower region.

27. The method of claim 25, wherein forming said lower region channels to have a maximum depth of substantially 0.048 inches, said upper region channels have a maximum depth of substantially 0.019 inches, and said lower and upper region channels have an internal radius of curvature of substantially 0.060 inches and a trough-to-trough separation of substantially 0.400 inches.

28. The method of claim 27, wherein forming said face insert receiving cavity has a side wall that extends around an entire perimeter of said cavity.

29. The method of claim 28, wherein forming said side wall has a lower section whereon a plurality of face inset plate positioning nubs are formed.

* * * * *